US007775864B2

(12) United States Patent
Miyazaki et al.

(10) Patent No.: US 7,775,864 B2
(45) Date of Patent: Aug. 17, 2010

(54) COIN PROCESSOR

(75) Inventors: Osamu Miyazaki, Kounosu (JP); Mitsuo Sakamoto, Saitama (JP); Soichi Ozaku, Moriya (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 0 days.

(21) Appl. No.: 12/368,623

(22) Filed: Feb. 10, 2009

(65) Prior Publication Data

US 2009/0215373 A1 Aug. 27, 2009

(30) Foreign Application Priority Data

Feb. 21, 2008 (JP) ..... P2008-040051

(51) Int. Cl.
*G07D 1/00* (2006.01)

(52) U.S. Cl. ..... 453/56; 453/61

(58) Field of Classification Search ..... 453/56, 453/61; 198/371.2, 416, 431, 456, 457.03, 198/462.3, 818, 820, 822, 836.1, 373, 406, 198/417, 860.3, 838.1, 837, 840; 53/212
See application file for complete search history.

(56) References Cited

U.S. PATENT DOCUMENTS 2,157,110 A * 5/1939 Bock et al. ..... 198/453
4,369,800 A * 1/1983 Watanabe et al. ..... 453/32
5,518,101 A * 5/1996 Simizu et al. ..... 194/317
5,899,804 A 5/1999 Chiba et al.
5,989,118 A 11/1999 Chiba et al.
2006/0040603 A1* 2/2006 Nishimura et al. ..... 453/3
2007/0060033 A1 3/2007 Kotani

FOREIGN PATENT DOCUMENTS

EP 0 831 429 A 3/1998
EP 1 542 174 A 6/2005
EP 1 647 949 A 4/2006
JP 3248849 11/2001

* cited by examiner

*Primary Examiner*—John Q. Nguyen
*Assistant Examiner*—Mark Beauchaine
(74) *Attorney, Agent, or Firm*—Nixon & Vanderhye P.C.

(57) ABSTRACT

A coin processor according to the present invention includes a temporary storage portion that temporarily stores coins, and the temporary storage portion includes: a conveyor belt; a one side conveyor guide that is disposed on one edge side of the conveyor belt in a width direction thereof; an other side conveyor guide that is disposed on an other edge side of the conveyor belt in the width direction with a spacing narrower than a diameter of a coin to be stored between the one side conveyor guide and the other side conveyor guide, and that slopes upward toward outside in the width direction; a drive portion that drives the conveyor belt; and a stacking surface guide that is provided at one end portion of the conveyor belt in a lengthwise direction thereof, and that slopes upward toward outside of the conveyor belt in the lengthwise direction.

10 Claims, 7 Drawing Sheets

COIN PROCESSOR

BACKGROUND OF THE INVENTION

1. Field of the Invention

The present invention relates to a coin processor and particularly relates to an improvement of the temporary storage portion thereof.

Priority is claimed on Japanese Patent Application No. 2008-040051, filed Feb. 21, 2008, the content of which is incorporated herein by reference.

2. Description of Related Art

A coin processor generally has a money receiving portion where coins are charged, an identifying portion that identifies coins that are charged in the money receiving portion, a temporary storage portion that temporarily stores coins that have been identified by the identifying portion, a returning portion that returns coins that have been temporarily stored in the temporary storage portion, and a housing portion that houses coins that have been temporarily stored in the temporary storage portion. In recent years, many coin processors have been adopted that use a conveyor belt that is capable of transporting coins in the temporary storage portion (for example, refer to Japanese Patent Publication No. 3248849 {Japanese Unexamined Patent Application, First Publication No. H10-97667}).

Coins that have been identified by the identifying portion are introduced to the temporary storage portion either directly from a selection hole or via a shoot. A state can arise in which coins pile up at the introduction portion of the temporary storage portion. When the conveyor belt is used in the temporary storage portion in the above manner, the coins are spread out on the conveyor belt by moving the conveyor belt, and this makes it possible to improve the storage efficiency. Also, coins that are stored in the temporary storage portion can be selectively conveyed to the storage portion and the returning portion by the conveyor belt. However, since the coins are accumulated on the conveyor belt in a disorderly manner, a state in which a coin spins freely in a standing state on the spot with respect to the rotating conveyor belt (the so-called repetition rotation phenomenon) and a state in which a coin becomes caught on the conveying exit (so-called bridging) and the like sometimes occur. As a result, coins become held up and are not properly conveyed.

SUMMARY OF THE INVENTION

An object of the present invention is to provide a coin processor that can prevent the coins from being held up even when using a conveyor belt for a temporary storage portion and that can properly convey coins.

In order to attain the above-mentioned object, a coin processor according to the present invention includes a temporary storage portion that temporarily stores coins, and the temporary storage portion includes: a conveyor belt; a one side conveyor guide that is disposed on one edge side of the conveyor belt in a width direction thereof; an other side conveyor guide that is disposed on an other edge side of the conveyor belt in the width direction with a spacing narrower than a diameter of a coin to be stored between the one side conveyor guide and the other side conveyor guide, and that slopes upward toward outside in the width direction; a drive portion that drives the conveyor belt; and a stacking surface guide that is provided at one end portion of the conveyor belt in a lengthwise direction thereof, and that slopes upward toward outside of the conveyor belt in the lengthwise direction.

According to this constitution, the one side conveyor guide that is disposed on one edge side of the conveyor belt in the width direction and the other side conveyor guide that is disposed on the other edge side of the conveyor belt in the width direction are disposed with a spacing that is narrower than the diameter of a coin to be stored. For this reason, when a coin is introduced to the temporary storage portion, due to the slope of the other side conveyor guide that slopes upward toward the outside in the width direction, the coin becomes an oblique orientation along this slope. Moreover, the coin makes contact with the three points of the conveyor belt, the one side conveyor guide, and the other side conveyor guide in approximately the center portion in the lengthwise direction of the conveyor belt. When driving the conveyor belt by the drive portion in the direction in which the upper surface thereof heads toward the one end portion in the lengthwise direction, while a coin makes contact with the conveyor belt, the one side conveyor guide, and the other side conveyor guide as described above, a force is applied to the lower end portion of the coin that makes contact with the conveyor belt to cause it to move toward the one end portion of the conveyor belt in the lengthwise direction. As a result, the coin moves toward the one end portion of the conveyor belt in the lengthwise direction while rotating as a whole. This coin mounts the stacking surface guide that is provided at this one end portion and that slopes upward toward the outside in the lengthwise direction of the conveyor belt and stops in the orientation that conforms to this stacking surface guide. The next coin mounts the coin that has stopped in the orientation that rises forward with respect to the conveying direction and stops in the orientation that follows this coin. By doing so, the coins that are introduced one after another to the temporary storage portion are one after another stacked in the lengthwise direction of the conveyor belt with similar oblique orientation. Thereby, it is possible to stack a plurality of coins that are one after another introduced to the temporary storage portion in alignment along the lengthwise direction of the conveyor belt while partially staggering with an approximately constant oblique orientation. Accordingly, it is possible to suppress the repetition rotation phenomenon and bridging of coins that occurs during conveying, and it is possible to properly convey coins by preventing coins from being held up.

In the coin processor according to the present invention, an upper portion side of the one side conveyor guide may slope so as to be positioned at the other edge side.

According to this constitution, since the upper portion side of the one side conveyor guide slopes so as to be positioned on the other edge side, it is possible to reliably put the coins in an oblique orientation along the slope of the other side conveyor guide. Also, it is possible to prevent the coins from colliding with other coins and flying out or shifting in the lateral direction during conveying or while stacked. Accordingly, by preventing coins from being held up, it is possible to ensure the proper conveying of coins.

In the coin processor according to the present invention, an introduction portion that introduces the coin to be stored to the conveyor belt may be formed in a vicinity of the other end portion of the other side conveyor guide in the lengthwise direction of the conveyor belt.

According to this constitution, since the introduction portion that introduces the coins to be stored to the conveyor belt is formed in the other side conveyor guide, coins satisfactorily becomes an oblique orientation along the slope of the other side conveyor guide, and make contact with the three points of the conveyor belt, the one side conveyor guide, and the other side conveyor guide. Therefore, it is possible to more smoothly carry out the above-described conveying and stacking of coins. Also, since the introduction portion is formed in the vicinity of the other end portion in the lengthwise direction of the conveyor belt, it is possible to increase the capacity of coins to be stored.

In the coin processor according to the present invention, the drive portion may normally and reversely rotate the conveyor belt.

According to this constitution, the drive portion can normally and reversely rotate the conveyor belt. For this reason, by driving the conveyor belt in the direction in which the conveying surface that is the upper surface thereof heads toward the one end portion in the lengthwise direction, the stacking of coins described above becomes possible. On the other hand, by driving the conveyor belt in the reverse direction, it is possible to release the stacking of coins and discharge the coins from the other end portion side in the lengthwise direction.

In the coin processor according to the present invention, the drive portion, when discharging coins from one of the one end portion side and the other end portion side of the conveyor belt in the lengthwise direction, may discharge the coins from one of the one end portion side and the other end portion side of the conveyor belt in the lengthwise direction after rotating the conveyor belt once in a reverse direction of a discharge direction or while repeating rotation of the conveyor belt in the discharge direction and the reverse direction.

According to this constitution, the drive portion, when discharging coins from one of the one end portion side and the other end portion side of the conveyor belt in the lengthwise direction, discharges the coins from one of the one end portion side and the other end portion side of the conveyor belt in the lengthwise direction after once rotating the conveyor belt in the reverse direction of the discharge direction or while repeating rotation of the conveyor belt in the discharge direction and the reverse direction. For this reason, it is possible to discharge coins after satisfactorily releasing the stacking state of the coins. Therefore, it is possible to prevent the coins from flying out in an improper direction and from becoming congested when discharging the coins.

In the coin processor according to the present invention, the stacking surface guide may move to a stacking position in which the stacking surface guide slopes upward toward the outside of the conveyor belt in the lengthwise direction and to a retracted position in which the stacking surface guide opens one end portion of the temporary storage portion in the lengthwise direction of the conveyor belt.

According to this constitution, when the stacking surface guide is in the stacking position in which the stacking surface guide slopes upward toward the outside in the lengthwise direction of the conveyor belt, it is possible to perform stacking of the coins as described above. Also, by putting the stacking surface guide in the retracted position in which the stacking surface guide opens the one end portion of the temporary storage portion in the lengthwise direction of the conveyor belt, it is possible to discharge coins from this one end portion.

The coin processor according to the present invention may further include a locking mechanism that locks the stacking surface guide in the stacking position.

According to this constitution, the coin processor further includes a locking mechanism that locks the stacking surface guide in the stacking position. For this reason, it is possible to prevent coins being improperly discharged from the one end portion in the lengthwise direction of the conveyor belt as a result of movement or the like of the stacking surface guide due to the weight of the coins that have been stacked.

The coin processor according to the present invention may further include an opening-closing gate that opens and closes an other end portion of the temporary storage portion in the lengthwise direction of the conveyor belt.

According to this constitution, by putting the other end portion of the temporary storage portion in the lengthwise direction of the conveyor belt in the closed state with the opening-closing gate, it is possible to prevent the coins from being improperly discharged from this other end portion. Also, by putting this opening-closing gate in the opened state, it is possible to discharge coins from the other end portion of the temporary storage portion in the lengthwise direction of the storage portion conveyor belt.

DETAILED DESCRIPTION OF THE INVENTION

A coin processor according to one embodiment of the present invention shall be described below with reference to the drawings.

Figure 1:
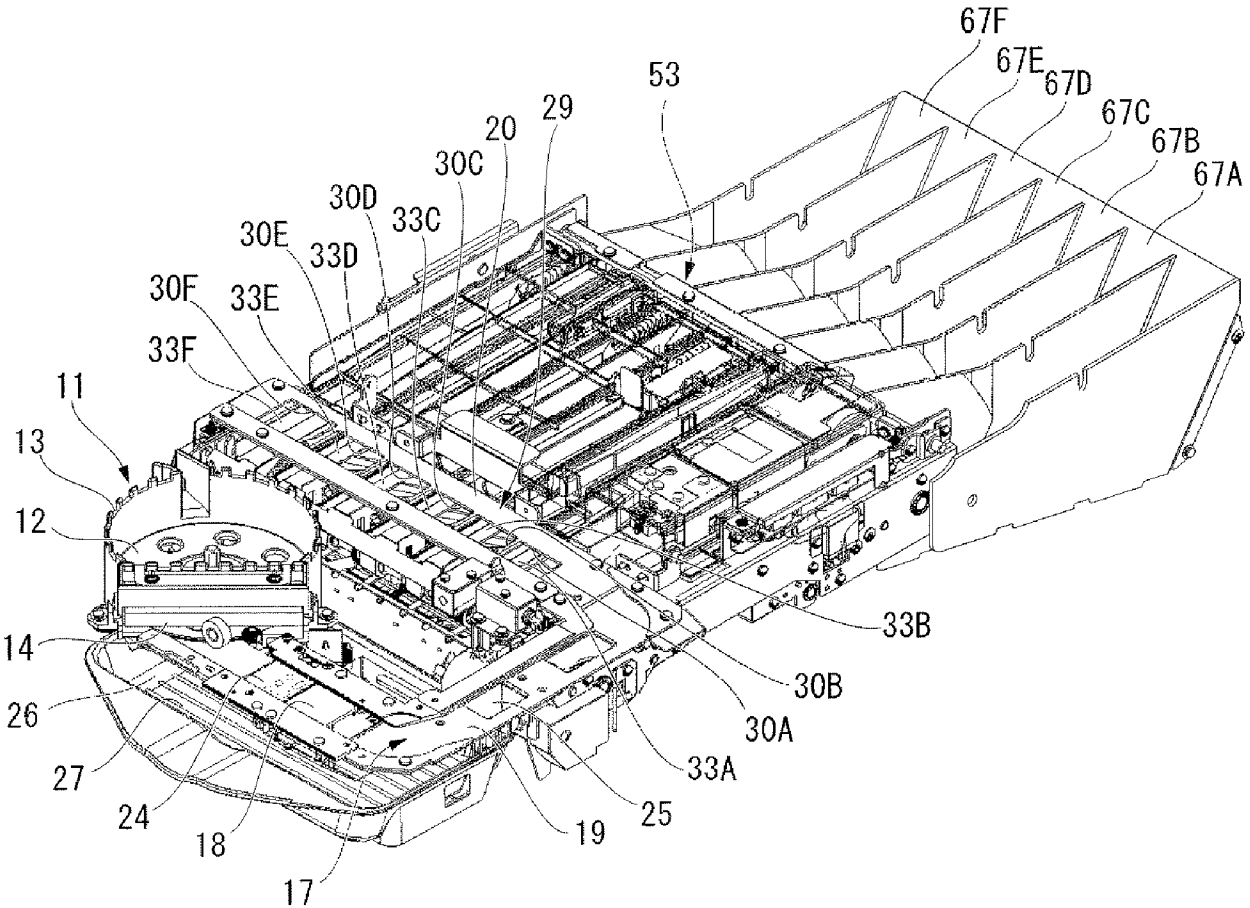
FIG. 1 is a perspective view showing an inner configuration of a coin processor according to one embodiment of the present invention.

FIG. 1 shows an internal configuration of the coin processor. At the front portion of the body of the coin processor is provided an money receiving port hopper (money receiving portion) 11 where loose coins of various denominations are fed from outside the machine. This money receiving port hopper 11 has a rotating disk 12, a standing wall portion 13, and a separating portion 14. The rotating disk 12 constitutes the bottom of the money receiving port hopper 11. The standing wall portion 13 has a circular shape which rises from the periphery of the rotating disk 12. The separating portion 14 is disposed at a cutaway portion of the standing wall portion 13, and forms a gap with the rotating disk 12 that is capable of passing one coin only. This money receiving port hopper 11 separates and feeds out coins one at a time that have been charged into the rotating disk 12 by passing the coins between the separating portion 14 and the rotating disk 12 with centrifugal force produced when the rotating disk 12 rotates.

At the body front portion side of the coin processor, a received money conveyance path 17 having a bent shape is formed adjacent to the money receiving port hopper 11. This received money conveyance path 17 has a first passage portion 18, a second passage portion 19, and a third passage portion 20. The first passage portion 18 extends along a tangential direction of the rotating disk 12 and in the horizontal direction of the body. The second passage portion 19 extends from the side of the first passage portion 18 opposite the money receiving port hopper 11 towards the rear of the body. The third passage portion 20 extends from the side of the second passage portion 19 opposite the first passage portion 18 so as to be parallel to the first passage portion 18. The received money conveyance path 17 accepts coins that are separated and fed out one at a time from the money receiving port hopper 11 at the first passage portion 18. The received money conveyance path 17 conveys received coins as they are in the horizontal orientation from the first passage portion 18 to the second transport portion 19 and the third transport portion 20 in that order with a received money conveyor belt not illustrated that is provided on the upper side.

An identifying portion 24 that determines the genuineness and denomination of coins that have been charged into the money receiving port hopper 11 and are being conveyed by the received money conveyance path 17 is provided in the first passage portion 18 of the received money conveyance path 17, and counts them.

In the second passage 19 of the received money conveyance path 17, a reject portion 25 that is capable of opening and closing is provided. A carton (returning portion) 27 is detachably mounted in a predetermined mounting portion 26 below the first passage portion 18. During the received money counting process that performs counting and storage of coins that are charged in the money receiving port hopper 11, coins that are identified as not acceptable from the identification result of the identifying portion 24 are guided to the carton 27 by the opening of the reject portion 25.

A sorting portion 29 that sorts according to denomination the coins that are identified as acceptable from the identification result of the identifying portion 24 during the received money counting process is provided in the third passage 20 of the received money conveyance path 17. This sorting portion 29 has sorting holes 30A to 30F according to denomination that drop the coins in the order of small diameter upward. That is, in the third passage portion 20, the sorting hole 30A that drops only 1 yen coins is formed furthest upstream. The sorting hole 30B that drops only 50 yen coins is formed on the downstream side thereof. The sorting hole 30C that drops only 5 yen coins is formed on the downstream side thereof. The sorting hole 30D that drops only 100 yen coins is formed on the downstream side thereof. The sorting hole 30E that drops only 10 yen coins is formed on the downstream side thereof. The sorting hole 30F that drops only 500 yen coins is formed on the downstream side thereof.

Provided under the third passage portion 20 of the received money conveyance path 17 are temporary storage portions 33A to 33F that temporarily store according to denomination the coins that have been identified by the identifying portion 24 and have been sorted according to denomination by the sorting holes 30A to 30F. That is, the temporary storage portion 33A that stores only 1 yen coins and extends in the front-back direction of the body is disposed under the sorting hole 30A. The temporary storage portion 33B that stores only 50 yen coins and extends in the front-back direction of the body is disposed under the sorting hole 30B. The temporary storage portion 33C that stores only 5 yen coins and extends in the front-back direction of the body is disposed under the sorting hole 30C. The temporary storage portion 33D that stores only 100 yen coins and extends in the front-back direction of the body is disposed under the sorting hole 30D. The temporary storage portion 33E that stores only 10 yen coins and extends in the front-back direction of the body is disposed under the sorting hole 30E. The temporary storage portion 33F that stores only 500 yen coins and extends in the front-back direction of the body is disposed under the sorting hole 30F. During the received money counting process, the coins that have been identified as acceptable from the identification result of the identifying portion 24 are distributed to the temporary storage portions 33A to 33F by the sorting holes 30A to 30F. Coins that cannot be stored in the temporary storage portions 33A to 33F are together stored in a batch storage portion not illustrated regardless of denomination.

Figure 2:
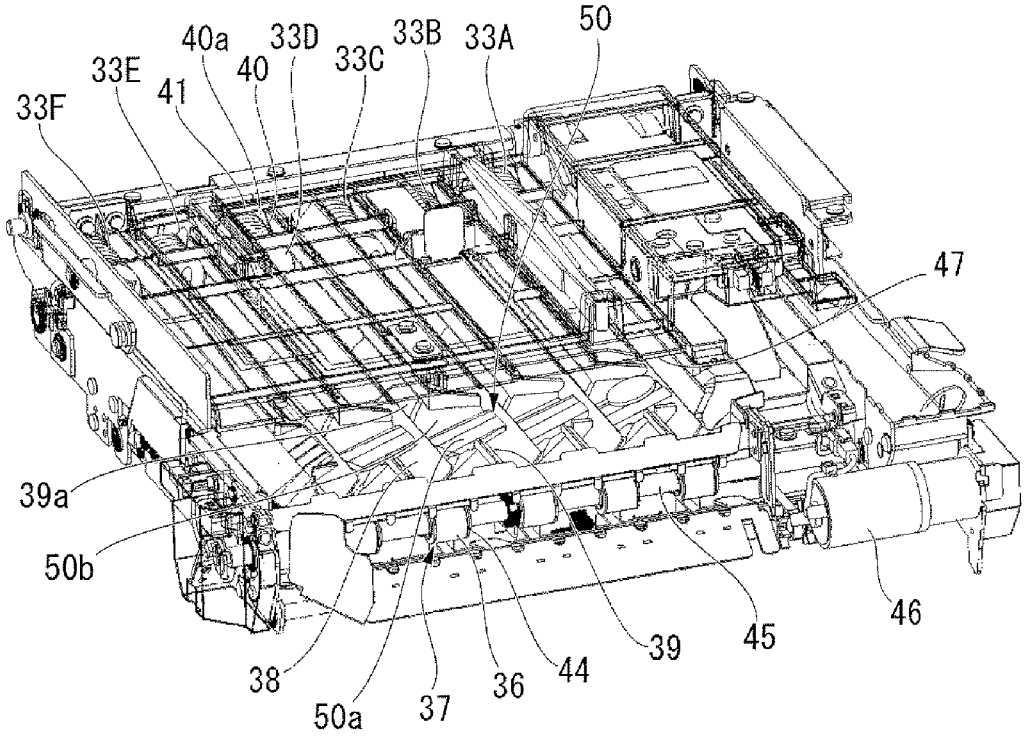
FIG. 2 is a perspective view showing an inner configuration of a body front portion side of the coin processor according to the embodiment of the present invention.

The temporary storage portions 33A to 33F have approximately the same constitution. The temporary storage portions 33A to 33F as shown in FIG. 2 have a belt conveyer 37, a one side conveyor guide 38, an other side conveyor guide 39, a stacking surface guide 40, and a stacking upper portion guide 41. The belt conveyer 37 has an endless storage portion conveyor belt (conveyor belt) 36 that extends in the front-rear direction of the body, conveys a coin in the lengthwise direction, and is horizontally disposed. The one side conveyor guide 38 is disposed adjacent to the one edge side of the storage portion conveyor belt 36 in the width direction and has approximately the same length as the storage portion conveyor belt 36. The other side conveyor guide 39 is disposed adjacent to the other edge side of the storage portion conveyor belt 36 in the width direction and has approximately the same length as the storage portion conveyor belt 36. The stacking surface guide 40 is disposed at the end portion of the body rear portion side that is one end portion of the storage portion conveyor belt 36 in the lengthwise direction. The stacking upper portion guide 41 is disposed above the stacking surface guide 40.

As shown by one end in FIG. 2, both ends of the storage portion conveyor belt 36 are suspended over pulleys 44 to constitute the belt conveyer 37. All of the pulleys 44 at the front side of the body of the belt conveyers 37 of the temporary storage portions 33A to 33F are fixed to a common drive shaft 45. This drive shaft 45 is driven by a drive motor 46 (drive portion) that is provided at the front portion side of the body. With this constitution, all of the storage portion conveyor belts 36 of the temporary storage portions 33A to 33F rotate in synchronization. The drive motor 46 is a reversible motor that can rotate in both normal and reverse directions, and so can rotate the storage portion conveyor belts 36 in both normal and reverse directions.

Figure 3:
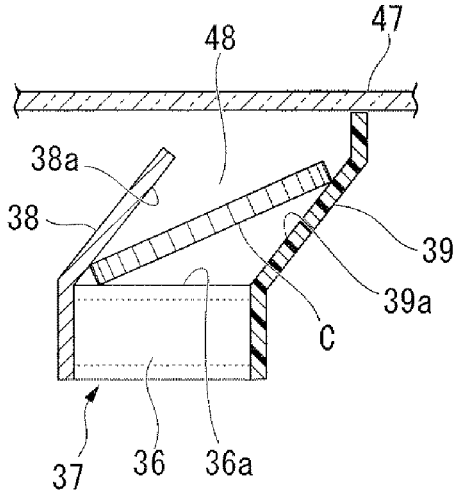
FIG. 3 is a cross-sectional view showing a temporary storage portion of the coin processor according to the embodiment of the present invention.

As shown in FIG. 3, the other side conveyor guide 39 is disposed to the upper side of the conveyor surface 36*a*, which is the upper surface of the storage portion conveyor belt 36. The upper side of the other side conveyor guide 39 slopes so as to be positioned to the outside of the storage portion conveyor belt 36 in the width direction. A conveyor sloping surface 39*a* that slopes upward toward the outside in the width direction of the storage portion conveyor belt 36 is formed on the upper surface of the other side conveyor guide 39.

The one side conveyor guide 38 is disposed to the upper side of the conveyor surface 36*a* of the storage portion conveyor belt 36. The upper side of the one side conveyor guide 38 slopes so as to be positioned on the other edge side of the storage portion conveyor belt 36 in the width direction A regulating sloping surface 38*a* that slopes upward toward the inside of the storage portion conveyor belt 36 in the width direction is formed on the lower surface of the one side conveyor guide 38. The one side conveyor guide 38 and the other side conveyor guide 39 slope in approximately the same manner.

As described above, the one side conveyor guide 38 is disposed so as to cover the storage portion conveyor belt 36 from the upper side. The one side conveyor guide 38 and the other side conveyor guide 39 are disposed so as to have a spacing in the horizontal direction that is narrower than the diameter of coins C that are stored and wider than the thickness of the coins C that are stored. As a result, the width of the storage portion conveyor belt 36 that is disposed between the lower end edge of the one side conveyor guide 38 and the lower end edge of the other side conveyor guide 39 has a width that is narrower than the diameter of the coins that are stored. Also, the one side conveyor guide 38 and the other side conveyor guide 39 are disposed so as to have a spacing that is narrower than the diameter of coins that are stored and wider than the thickness of the coins that are stored even at the position of shortest distance. At the upper side of the one side conveyor guide 38 and the other side conveyor guide 39, a top plate 47 that consists of a common transparent material is disposed for all of the temporary storage portions 33A to 33F except for the front portion side of the body. A space between the one side conveyor guide 38, the other side conveyor guide 39, the storage portion conveyor belt 36, and the top plate 47 becomes a storage space 48 that stores coins. This storage space 48 extends in the lengthwise direction of the storage portion conveyor belt 36.

In the other side conveyor guide 39, an introduction portion 50 is formed as shown in FIG. 2 where the aforementioned top plate 47 is not provided in the vicinity of the other end portion in the lengthwise direction of the storage portion conveyor belt 36, that is, in the vicinity of the end portion of the front portion side of the body. The introduction portion 50 introduces coins to be stored to top of the storage portion conveyor belt 36. This introduction portion 50 accepts coins that are conveyed in an approximately horizontal orientation by the received money conveyance path 17 and dropped by the sorting portion 29 and guides them to the side of the storage portion conveyor belt 36 and the one side conveyor guide 38. The introduction portion 50 has an introduction sloping surface 50*a* that slopes so that the side at the storage portion conveyor belt 36 is positioned at the lower side. The angle formed by this introduction sloping surface 50*a* and the storage portion conveyor belt 36 is an obtuse angle and is greater than the angle formed by the conveyor sloping surface 39*a* and the storage portion conveyor belt 36. As a result, a sloping step surface 50*b* is formed so as to be positioned on the upper side the further to the rear portion side of the body, between the introduction sloping surface 50*a* and the conveyor sloping surface 39*a*.

Figure 4:
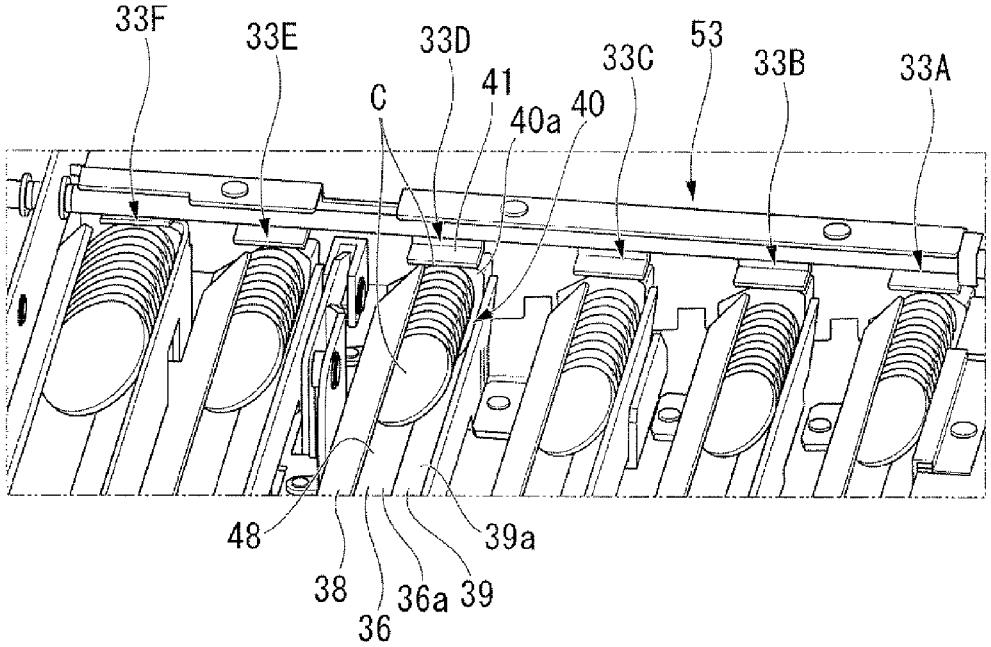
FIG. 4 is a perspective view of a body rear portion side showing the temporary storage portion of the coin processor according to the embodiment of the present invention.
Figure 5:
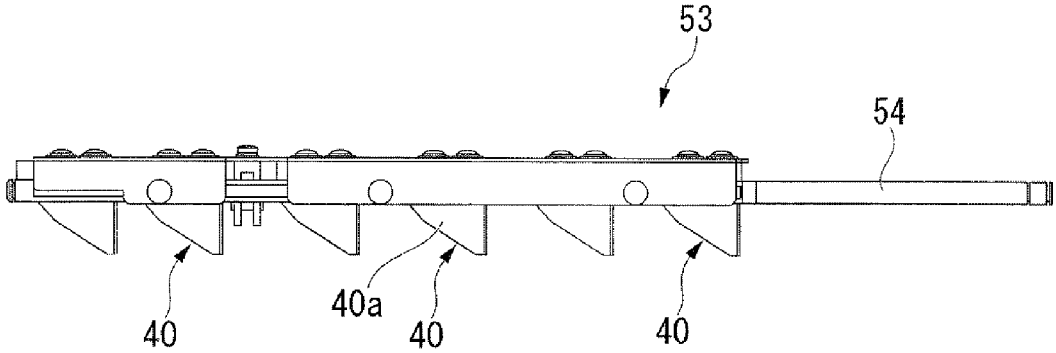
FIG. 5 is a plan view showing a housing opening-closing gate of the coin processor according to the embodiment of the present invention.
Figure 6:
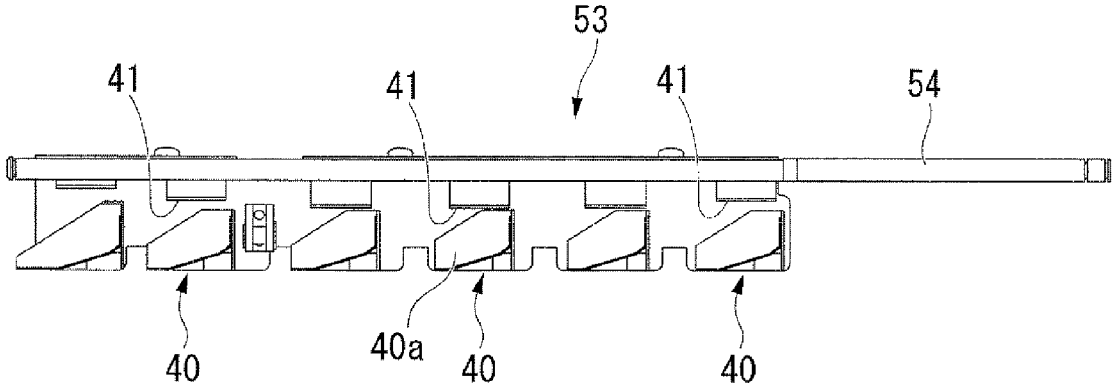
FIG. 6 is an elevation view showing the housing opening-closing gate of the coin processor according to the embodiment of the present invention.
Figure 7:
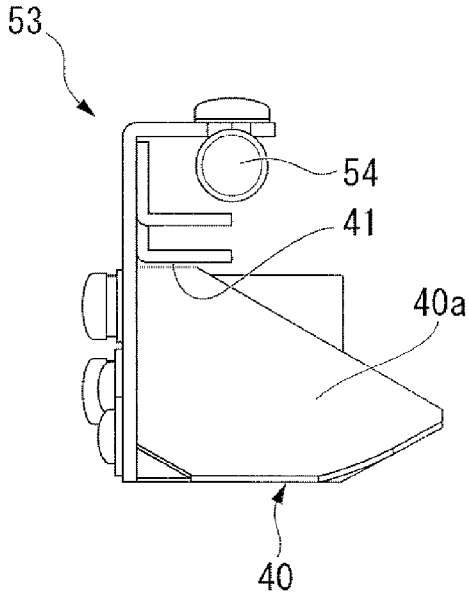
FIG. 7 is a side view showing the housing opening-closing gate of the coin processor according to the embodiment of the present invention.

The stacking surface guide 40, as shown in FIG. 4, is disposed further to the upper side than the conveyor surface 36*a* of the storage portion conveyor belt 36. On the upper surface of the stacking surface guide 40, a stack slope surface 40*a* is formed that slopes upward toward the outside in the lengthwise direction of the storage portion conveyor belt 36. This stack slope surface 40*a* blocks one end portion of the storage space 48 in the lengthwise direction of the storage portion conveyor belt 36 (the one end portion of the temporary storage portions 33A to 33F in the lengthwise direction of the storage portion conveyor belt 36).

The stacking upper portion guide 41 has a plate shape and is disposed horizontally above the upper end portion of the stacking surface guide 40.

During the received money counting process, coins that drop one at a time from the sorting hole 30D shown for example in FIG. 1 land on the introduction sloping surface 50*a* of the other side conveyor guide 39 of the temporary storage portion 33D shown in FIG. 2. The coin then descends the introduction sloping surface 50*a* to the side of the one side conveyor guide 38 and the storage portion conveyor belt 36. Next, this coin slides on the conveyor surface 36*a* of the storage portion conveyor belt 36, and abuts the edge of the one side conveyor guide 38. Thereby, this coin makes contact with the three points of the introduction sloping surface 50*a*, the regulating sloping surface 38*a* of the one side conveyor guide 38, and the conveyor surface 36*a* of the storage portion conveyor belt 36 in approximately the center portion in the lengthwise direction of the storage portion conveyor belt 36 in an orientation along the introduction sloping surface 50*a* (an orientation that slopes with respect to the width direction of the storage portion conveyor belt 36).

During this received money counting process, the drive motor 46 is driven in the forward direction, and whereby the storage portion conveyor belt 36 is normally driven in the direction in which the conveyor surface 36*a* heads toward the stacking surface guide 40. Thereby, while a coin makes contact with the storage portion conveyor belt 36, the one side conveyor guide 38, and the other side conveyor guide 39, a force is applied to the lower end portion of the coin that makes contact with the storage portion conveyor belt 36 to cause it to move toward the stacking surface guide 40. As a result, the coin is moved toward the stacking surface guide 40 while rotating as a whole. In the initial stage of this movement, the coin moves in the order of the introduction sloping surface 50*a* of the other side conveyor guide 39, the step surface 50*b*, and the conveyor sloping surface 39*a*.

As shown in FIG. 3, the coin C maintains the slope orientation in which one end portion at the sloping lower side of the upper surface makes contact with the regulating sloping surface 38*a*, one end portion of the sloping lower side of the lower surface makes contact with the conveyor surface 36*a*, and the other end portion of the sloping upper side of the lower surface makes contact with the conveyor sloping surface 39*a*. The coin C entirety rotates clockwise when viewed from above so as to head in the direction of the stacking surface guide 40 while maintaining this orientation, and thereby moves in the direction of the stacking surface guide 40. The coin C, as shown in FIG. 4, mounts the stack slope surface 40*a* of the stacking surface guide 40 that slopes upward toward the outside in the lengthwise direction of the storage portion conveyor belt 36 at the terminal portion in the conveying direction, and stops in an orientation conforming to this stack slope surface 40*a*, that is, an orientation that slopes upward toward the outside in the lengthwise direction of the storage portion conveyor belt 36.

In other words, the stacking surface guide 40 causes the coin C that is conveyed in the sloped state with respect to the width direction of the storage portion conveyor belt 36 to slope upward toward the front in the conveying direction of the storage portion conveyor belt 36. At this time, the coin C makes surface contact with the stack slope surface 40*a* of the stacking surface guide 40 and the orientation is stable.

The subsequent coins C that are conveyed in the same manner mount the coin C that has stopped in the orientation sloping so as to rise forward with respect to the conveying direction and stop by making surface contact in the orientation conforming to this coin C. By doing so, the coins that are introduced one after another to the temporary storage portions 33A to 33F during the received money counting process are one after another stacked and stored in an aligned state along the lengthwise direction of the storage portion conveyor belt 36 with the same oblique orientation. At this time, when many coins C are stacked, the drive force of the storage portion conveyor belt 36 travels as pressure to the coins on the side of the stacking surface guide 40 via each coin C. As a result, the coins C on the side of the stacking surface guide 40 try to climb over the stacking surface guide 40 or the coins C on the lower side of the stack, but this movement is restricted by the stacking upper portion guide 41.

During the received money counting process, the coins that fall from the other sorting holes 30A to 30C, 30E and 30F are similarly stacked as above in the corresponding temporary storage portions 33A to 33C, 33E and 33F. The respective angle of the conveyor sloping surface 39*a*, the regulating sloping surface 38*a*, the introduction sloping surface 50*a*, and the stack slope surface 40*a* and the like are set to differing angles for each denomination so as to be suitable in accordance with the coin diameter, that is, set for each of the temporary storage portions 33A to 33F.

All of the stacking surface guides 40 and the stacking upper portion guides 41 of the temporary storage portions 33A to 33F are made into a unit to constitute a housing opening-closing gate 53 as shown in FIG. 5 to FIG. 9. In this housing opening-closing gate 53, a housing gate shaft 54 is attached. This housing opening-closing gate 53 is rotated by a housing gate opening-closing mechanism 55 shown in FIG. 8 and FIG. 9 near the housing opening-closing gate 53 via this housing gate shaft 54. That is, the rotation of a gate motor 56 of this housing gate opening-closing mechanism 55 is transmitted to the housing gate shaft 54 via a link mechanism 57 of the housing gate opening-closing mechanism 55. As a result, the housing opening-closing gate 53 rotates approximately 90 degrees. The housing opening-closing gate 53 is made to be rotatable (movable) between a stacking state and a retracted state. The stacking state is a state (the state shown in FIG. 8) in which the stack slope surface 40*a* of the stacking surface guide 40 slopes as described above and the stacking upper portion guide 41 is positioned above the stacking surface guide 40 to block one end portion in the lengthwise direction of the storage space 48 by the stacking surface guide 40. The retracted state is the state (the state shown in FIG. 9) in which the stacking surface guide 40 and the stacking upper portion guide 41 rotate approximately 90 degrees downward and so open the one end portion of the storage space 48 in the lengthwise direction.

Figure 8:
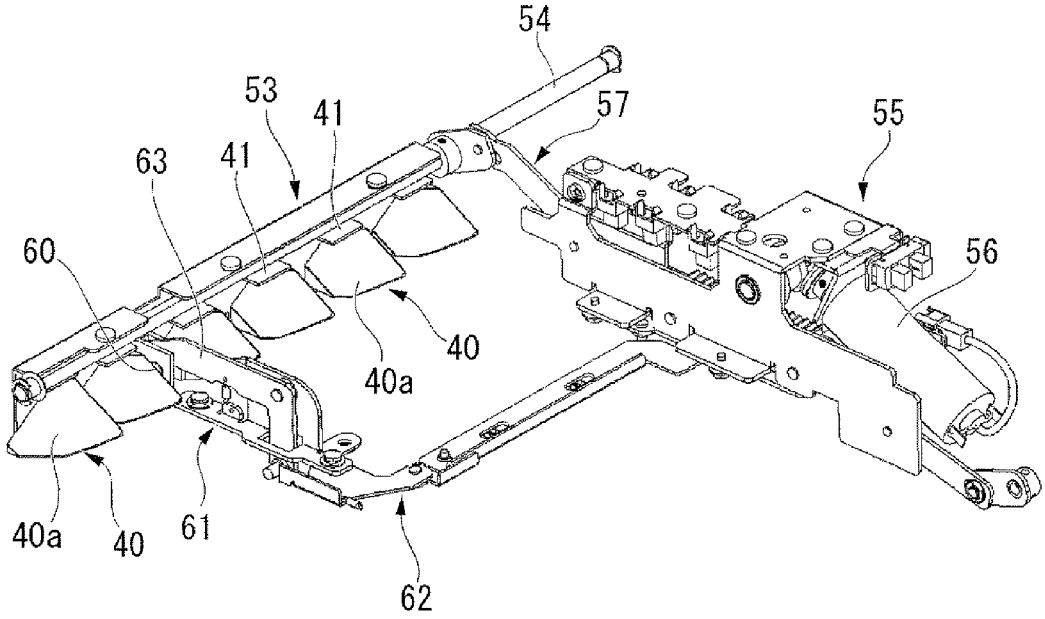
FIG. 8 is a perspective view showing the housing opening-closing gate, a housing gate opening-closing mechanism, and a housing gate locking mechanism of the coin processor according to the embodiment of the present invention, and shows a stacking state of the housing opening-closing gate.
Figure 9:
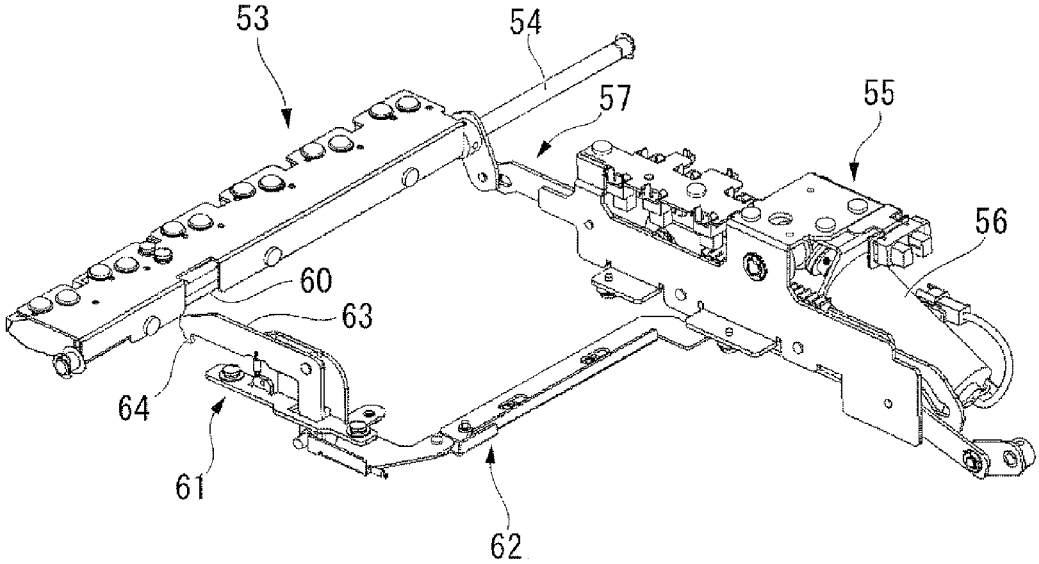
FIG. 9 is a perspective view showing the housing opening-closing gate, the housing gate opening-closing mechanism, and the housing gate locking mechanism of the coin processor according to the embodiment of the present invention, and shows a retracted state of the housing opening-closing gate.

A lock pin 60 is attached to the housing opening-closing gate 53. A housing gate locking mechanism (locking mechanism) 61 is provided near the housing opening-closing gate 53. The housing gate locking mechanism 61 locks the housing opening-closing gate 53 so that the gate 53 cannot rotate by engaging with the lock pin 60 of the housing opening-closing gate 53 in which the stacking surface guide 40 and the stacking upper portion guide 41 is in the stacking state. The housing gate locking mechanism 61 rotates a lock member 63 at the distal end via a link mechanism 62 with driving of a solenoid that is not illustrated. Specifically, this housing gate locking mechanism 61, as shown in FIG. 8, rotates the lock member 63 between a locking state in which the housing opening-closing gate 53 is locked by a hook portion 64 shown in FIG. 9 at the distal end of the lock member 63 engaging with the lock pin 60, and an unlocking state in which the housing opening-closing gate 53 is unlocked by releasing the engagement of the hook portion 64 with the lock pin 60. The states in which the housing gate opening-closing mechanism 55 puts the housing opening-closing gate 53 in the above-described stacking state, and the housing gate locking mechanism 61 is in a locking state in which the housing opening-closing gate 53 is locked, are standby states.

As shown in FIG. 1, housing portions 67A to 67F of each respective denomination are provided below the body rear portion side of the temporary storage portions 33A to 33F. The housing portions 67A to 67F of each respective denomination store coins temporarily stored in the temporary storage portions 33A to 33F. During the received money counting process, the housing opening-closing gate 53 is put in an open state and the storage portion conveyor belt 36 normally rotates by forward driving of the drive motor 46 in the direction in which the conveyor surface 36*a* heads toward the rear of the body. Thereby a coin of the temporary storage portion 33A falls in the housing portion 67A located below and is stored. A coin of the temporary storage portion 33B falls in the housing portion 67B located below and is stored. A coin of the temporary storage portion 33C falls in the housing portion 67C located below and is stored. A coin of the temporary storage portion 33D falls in the housing portion 67D located below and is stored. A coin of the temporary storage portion 33E falls in the housing portion 67E located below and is stored. A coin of the temporary storage portion 33F falls in the housing portion 67F located below and is stored.

At the end portion of the front portion side of the body that is the other end in the lengthwise direction of all of the storage portion conveyor belts 36 of the temporary storage portions 33A to 33F are provided a return opening-closing gate (opening-closing gate) 70 that opens and closes these end portions. The return opening-closing gate 70 has a return guide 71 and a plurality of regulating portions 72. The return guide 71 is plate shaped and slopes downward toward the outside in the lengthwise direction of the storage portion conveyor belt 36. The regulating portion 72 is plate shaped and projects downward from the return guide 71 so as to intersect with the storage portion conveyor belts 36 in the lengthwise direction.

Figure 12:
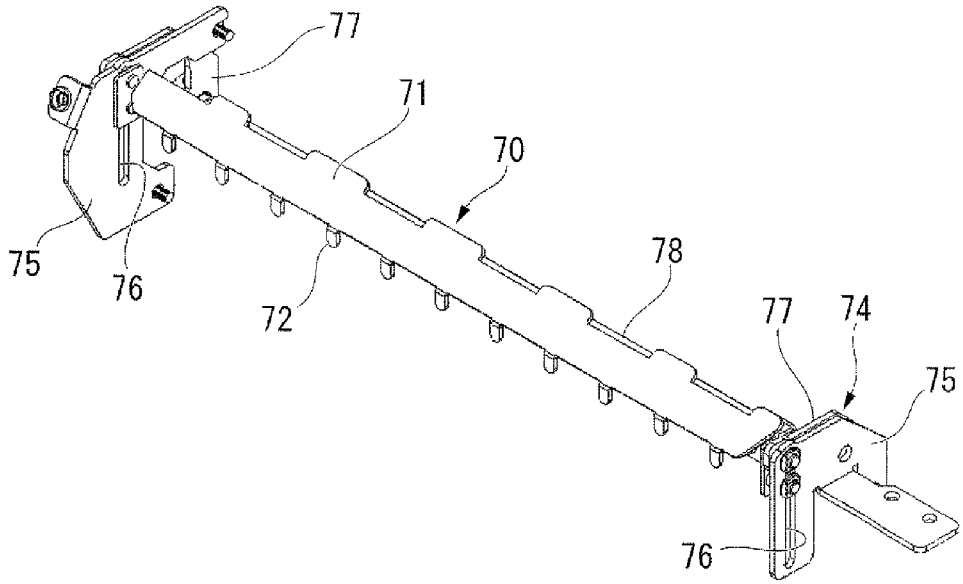
FIG. 12 is a perspective view showing the return opening-closing gate and a return gate opening-closing mechanism of the coin processor according to the embodiment of the present invention, and shows a closed state of the return opening-closing gate.
Figure 13:
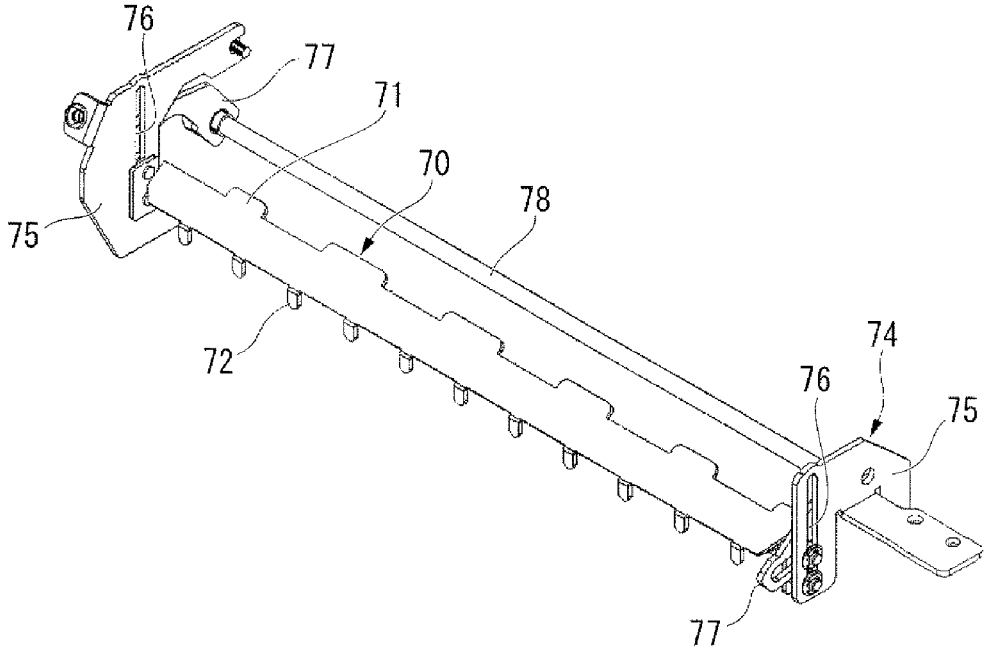
FIG. 13 is a perspective view showing the return opening-closing gate and the return gate opening-closing mechanism of the coin processor according to the embodiment of the present invention, and shows an opened state of the return opening-closing gate.

The return opening-closing gate 70 is capable of being raised and lowered by a return gate opening-closing mechanism 74 shown in FIG. 12 and FIG. 13. This return gate opening-closing mechanism 74 has guide members 75 that are disposed on both sides of the return opening-closing gate 70. Guide grooves 76 extend vertically in the guide members 75. The return opening-closing gate 70 is supported to be capable of going up and down by these guide grooves 76. The return gate opening-closing mechanism 74 has link arms 77, a return gate shaft 78, and a lift motor not illustrated. The link arms 77 engage with both end portions of the return opening-closing gate 70. The return gate shaft 78 is linked to the link arms 77. The lift motor drives the return gate shaft 78. The return opening-closing gate 70 is raised and lowered by the return gate shaft 78 being rotated by this lift motor.

Figure 10:
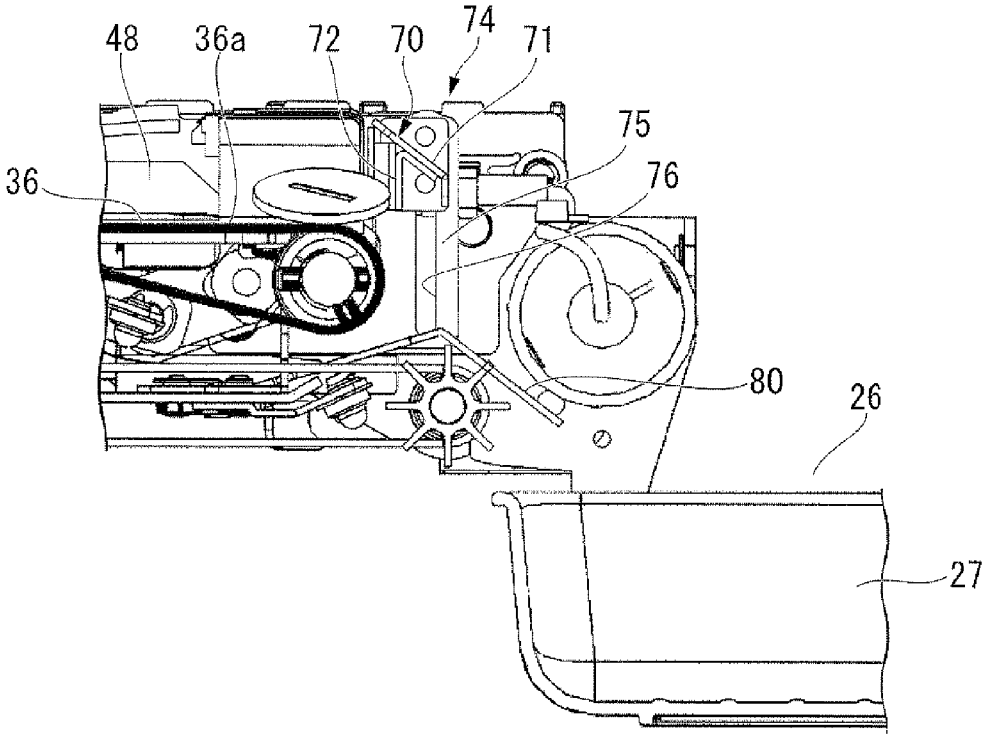
FIG. 10 is a side cross-sectional view of the body front portion side of the coin processor according to the embodiment of the present invention, and shows a closed state of a return opening-closing gate.
Figure 11:
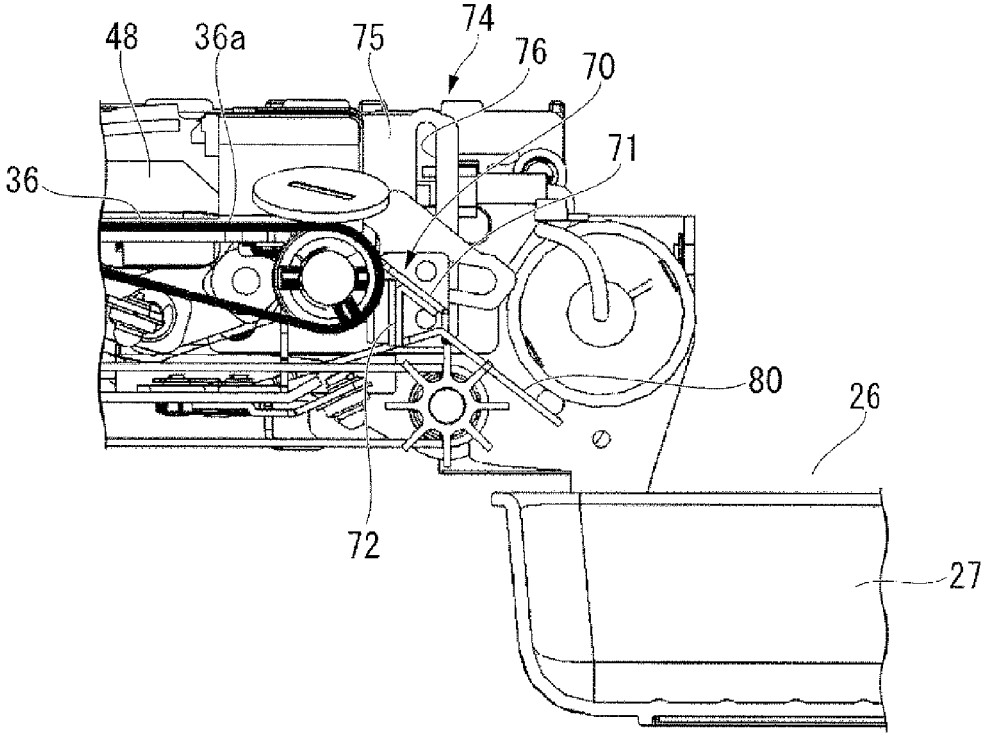
FIG. 11 is a side cross-sectional view of the body front portion side of the coin processor according to the embodiment of the present invention, and shows an opened state of the return opening-closing gate.

As shown in FIG. 10, when the return opening-closing gate 70 is in the closed state in which it has been raised, it blocks the other end portions in the lengthwise direction of the storage portion conveyor belts 36 of all of the storage spaces 48 of the temporary storage portions 33A to 33F (that is, the other end portions of the temporary storage portions 33A to 33F in the lengthwise direction of the storage portion conveyor belts 36) by the plurality of regulating portions 72 and the return guide 71 so that the release of coins becomes impossible. Thereby, the improper dropping of coins is regulated. On the other hand, as shown in FIG. 11, when the return opening-closing gate 70 is in the opened state in which it has been lowered, it opens the other end portions in the lengthwise direction of the storage portion conveyor belts 36 of all of the storage spaces 48 of the temporary storage portions 33A to 33F so that the release of coins becomes possible.

A return gate base 80 that has the same slope as the return guide 71 is provided on an approximate extended line at the front side of the body of the return guide 71 when the return opening-closing gate 70 is in the open state in which it has been lowered. The carton 27 that is mounted on the mounting portion 26 described above is disposed on the extended line at the front side of the body of this return gate base 80. Therefore, during the received money counting process, with the return opening-closing gate 70 in the opened state, when the storage portion conveyor belt 36 is reverse driven by reverse driving of the drive motor 46 in the direction in which the conveyor surface 36*a* heads toward the front of the body, all of the coins of the temporary storage portions 33A to 33F are conveyed to the other end portions in the lengthwise direction of the storage portion conveyor belts 3 6. Thereby, the coins are discharged to the front portion side of the body from the storage portion conveyor belt 36. The return opening-closing gate 70 and the return guide 71 guide the coins that are discharged to the carton 27 described above. The state of putting the return opening-closing gate 70 into the closed state described above is the standby state of the return gate opening-closing mechanism 74.

The housing portions 67A to 67F of each respective denomination can feed out coins that are housed to the front portion side of the body while counting during the money dispersing process. The coins that are fed out from the housing portions 67A to 67F during the money dispersing process are discharged to the carton 27 that is mounted on the mounting portion 26.

In such a coin processor, when loose coins are charged into the money receiving port hopper 11 and an operator perform an input to start the received money counting process with a operation portion not illustrated, a control portion not illustrated drives a received money conveyor belt not illustrated while rotating the rotating disk 12, with the housing gate opening-closing mechanism 55, the housing gate locking mechanism 61, and the return gate opening-closing mechanism 74 in the standby states described above. Moreover, by normally rotating the drive motor 46, the storage portion conveyor belts 36 of all of the temporary storage portions 33A to 33F are made to normally rotate. Thereby, the loose coins that have been charged into the money receiving port hopper 11 are separated by the separating portion 14, and are one at a time fed out to the received money conveyance path 17. Then, the coins are basically conveyed by a received money conveyor belt not illustrated from the first passage portion 18 to the second passage portion 19 to the third passage portion 20 in that order.

During conveyance, the identifying portion 24 that is provided in the first passage portion 18 identifies the coin. The control portion guides coins that are identified as not acceptable from the identification result to the detachable carton 27 that is mounted in the mounting portion 26 under the first passage portion 18 by opening the rejection portion 25 of the second passage portion 19. Coins that are identified as acceptable from the identification result are conveyed to the sorting portion 29 of the third passage portion 20.

Then, in the sorting portion 29, only 1 yen coins drop into the temporary storage portion 33A from the sorting hole 30A that is furthest upstream. Only 50 yen coins drop into the temporary storage portion 33B from the sorting hole 30B that is downstream thereof. Only 5 yen coins drop into the temporary storage portion 33C from the sorting hole 30C that is downstream thereof. Only 100 yen coins drop into the temporary storage portion 33D from the sorting hole SOD that is downstream thereof. Only 10 yen coins drop into the temporary storage portion 33E from the sorting hole 30E that is downstream thereof. Only 500 yen coins drop into the temporary storage portion 33F from the sorting hole 30F that is downstream thereof.

For example, a 100 yen coin that drops from the sorting hole 30D falls as is with an approximately horizontal orientation onto the introduction sloping surface 50*a* of the introduction portion 50 that is formed in the other side conveyor guide 39 of the temporary storage portion 33D shown in FIG. 2. Next, the coin is guided to the side of the storage portion conveyor belt 36 and the one side conveyor guide 38 by the slope of the introduction sloping surface 50*a*. At this time, the storage portion conveyor belt 36 as described above is normally driven in the direction in which the conveyor surface 36*a* heads toward the stacking surface guide 40. For this reason, while the coin is in contact with the storage portion conveyor belt 36, the one side conveyor guide 38, and the other side conveyor guide 39, a force that moves the coin toward the stacking surface guide 40 is applied to the lower end portion of the coin in contact with the storage portion conveyor belt 36. As a result, as shown in FIG. 3, the coin C, while maintaining the oblique orientation in which one end portion at the sloping lower side of the upper surface makes contact with the regulating sloping surface 38*a*, one end portion of the sloping lower side of the lower surface makes contact with the conveyor surface 36*a*, and the other end portion of the sloping upper side of the lower surface makes contact with the conveyor sloping surface 39*a*, rotates clockwise when viewed from above so that the lower portion heads in the direction of the stacking surface guide 40, and thereby moves in the direction of the stacking surface guide 40. The coin, as shown in FIG. 4, mounts the stack slope surface 40*a* of the stacking surface guide 40 that slopes upward toward the outside in the lengthwise direction of the storage portion conveyor belt 36 at the terminal portion in the conveying direction, and stops in an orientation that slopes upward toward the outside in the lengthwise direction of the storage portion conveyor belt 36.

The subsequent coins C that are conveyed in the same manner mount the coin C that has stopped in the orientation sloping so as to rise forward with respect to the conveying direction and stop in this orientation conforming to the coin C. By doing so, the coins C that are introduced one after another to the temporary storage portion 33D are one after another stacked and stored in an aligned state along the lengthwise direction of the storage portion conveyor belt 36 with the same sloping orientation. At this time, even if the coin C on the side of the stacking surface guide 40 tries to climb over the stacking surface guide 40 or the coins C on the lower side of the stack, this movement is restricted by the stacking upper portion guide 41.

The coins that fall from the other sorting holes 30A to 30C, 30E and 30F are similarly stacked as above in the corresponding temporary storage portions 33A to 33C, 33E and 33F.

In this way, the coins that have been identified as acceptable from the identification result of the identifying portion 24 are distributed to the temporary storage portions 33A to 33F according to denomination, and stored in an aligned state that is stacked in sequence with an orientation sloping upward toward the outside in the lengthwise direction of one end portion of the storage portion conveyor belt 36.

When all of the coins that are charged into the money receiving port hopper 11 are distributed into the carton 27 and any of the temporary storage portions 33A to 33F, the control portion stops driving of the rotating disk 12 and the received money conveyor belt not illustrated, and stops driving of the storage portion conveyor belt 36 by the drive motor 46. Moreover, the control portion causes the counting result of each denomination of coins identified as acceptable from the identification result of the identifying portion 24 to be displayed in a display portion not illustrated.

When the operator, seeing this display, inputs an acknowledgement operation into the operation portion that is not illustrated, the control portion judges the stored amount of the coins of the temporary storage portions 33A to 33F from the identification result of the identifying portion 24. In the case of any storage amount being at or below a predetermined threshold value, the control portion drives the solenoid not illustrated of the housing gate locking mechanism 61 to rotate the lock member 63 by the link mechanism 62 and thereby the engagement of the hook portion 64 with the lock pin 60 are released. As a result, the housing gate locking mechanism 61 is put in the lock release state. Next, the control portion drives the gate motor 56 of the housing gate opening-closing mechanism 55 and causes the housing opening-closing gate 53 to move to the retracted position via the link mechanism 57. Thereby, the discharge outlets at the one end side that had been blocked by the stacking surface guides 40 of the temporary storage portions 33A to 33F are opened. Moreover, the control portion causes the drive motor 46 to normally drive the storage portion conveyor belt 36 and thereby houses the coins in the housing portions 67A to 67F. At this time, by causing the housing opening-closing gate 53 to move to the retracted position, the coins at the side of the stacking surface guide 40 drop into the housing portions 67A to 67F. As for the remaining coins that have not dropped, the slope angle with respect to the storage portion conveyor belt 36 becomes small in the state of adjacent coins overlapping each a portion. These remaining coins are housed in the housing portions 67A to 67F by conveying of the storage portion conveyor belt 36.

On the other hand, in the case of the storage amount of coins in at least any one of the temporary storage portions 33A to 33F exceeding the predetermined threshold value described above, first the storage portion conveyor belt 36 is reverse driven by a predetermined amount by the drive motor 46. That is, the storage portion conveyor belt 36 is once rotated in the direction that is the reverse of the discharge direction. Then, the coins that are stacked in the temporary storage portions 33A to 33F move as a whole in the direction to separate from the stacking surface guide 40. At this time, the interval of adjacent coins widens on the storage portion conveyor belt 36 so that the overlapping amount of adjacent coins becomes less, whereby the slope angle with respect to the storage portion conveyor belt 36 becomes small. Thereafter, the control portion drives the solenoid not illustrated of the housing gate locking mechanism 61 to rotate the lock member 63 by the link mechanism 62 and thereby the engagement of the hook portion 64 with the lock pin 60 are released. As a result the housing gate locking mechanism 61 is put in the lock release state. Next, the control portion drives the gate motor 56 of the housing gate opening-closing mechanism 55 and causes the housing opening-closing gate 53 to move to the retracted position via the link mechanism 57, and also continuously normally drives the storage portion conveyor belt 36 with the drive motor 46. That is, the storage portion conveyor belt 36 is continuously rotated in the forward direction with respect to the discharge direction. Thereby, the coins of the temporary storage portions 33A to 33F, in which the overlap amount has become small, are housed in the housing portions 67A to 67F.

In the case of the storage amount of coins in at least any one of the temporary storage portions 33A to 33F exceeding the predetermined threshold value described above, when the control portion discharges coins by rotating the storage portion conveyor belt 36 in the reverse direction of the discharge direction and then rotating the storage portion conveyor belt 36 in the forward direction, the normal rotation and reverse rotation of the storage portion conveyor belt 36 by the drive motor 46 may be repeated.

That is, after the control portion rotates the storage portion conveyor belt 36 in the reverse direction of the discharge direction similarly to described above, it causes the housing opening-closing gate 53 to move to the retracted position. Then, the control portion discharges a portion of coins by rotating the storage portion conveyor belt 36 in the forward direction by a first predetermined amount. The control portion again rotates the storage portion conveyor belt 36 in the reverse direction of the discharge direction by a second predetermined amount (first predetermined amount>second predetermined amount), and then rotates the storage portion conveyor belt 36 in the forward direction by a third predetermined amount (third predetermined amount>second predetermined amount) to discharge a portion of coins. The control portion then once again rotates the storage portion conveyor belt 36 in the reverse direction of the discharge direction by the second predetermined amount, and then rotates the storage portion conveyor belt 36 in the forward direction by the third predetermined amount. By suitably repeating this operation, a moderate amount of the coins are intermittently discharged. At this time, in accordance with the storage amount of coins and the conveyance torque, the control may be performed so that for example as the storage amount increases, the second predetermined amount and the third predetermined amount are reduced and the number of repetitions increase.

When sufficient time has elapsed for housing all of the coins of the temporary storage portions 33A to 33F in the housing portions 67A to 67F, the control portion stops the drive motor 46 and returns the housing gate opening-closing mechanism 55 and the housing gate locking mechanism 61 to the standby state.

Meanwhile, when the operator, seeing the identification result of the identification portion 24, inputs a return operation into the operation portion that is not illustrated, the control portion judges the stored amount of the coins of the temporary storage portions 33A to 33F from the identification result of the identifying portion 24. In the case of any storage amount being at or below a predetermined threshold value, the control portion puts the return opening-closing gate 70 in the lowered opened state by rotating the return gate shaft 78 with the lift motor not illustrated of the return gate opening-closing mechanism 74. Thereby, the other end side discharge outlets that had been blocked by the return opening-closing gate 70 of the temporary storage portions 33A to 33F are opened. Moreover, the control portion drives in reverse the storage portion conveyor belt 36 with the drive motor 46. Thereby, the coins of the temporary storage portions 33A to 33F are discharged to the carton 27 that is mounted on the mounting portion 26 via the return guide 71 of the return opening-closing gate 70 and the return gate base 80. At this time, due to the moving away of the coins from the stacking surface guide 40, and the conveying force of the storage portion conveyor belt 36, the interval between coins widens on the storage portion conveyor belt 36 so that the overlapping amount of adjacent coins becomes less, whereby the slope angle with respect to the storage portion conveyor belt 36 becomes small. In this state, the coins are discharged one after another from the storage portion conveyor belt 36 to the carton 27.

In the case of the storage amount of coins in at least any one of the temporary storage portions 33A to 33F exceeding the predetermined threshold value described above, the return opening-closing gate 70 is put in the lowered opened state by rotating the return gate shaft 78 with the lift motor not illustrated of the return gate opening-closing mechanism 74. Thereby, the other end side discharge outlets that had been blocked by the return opening-closing gate 70 of the temporary storage portions 33A to 33F are opened. Moreover, the storage portion conveyor belt 36 is once driven in reverse with the drive motor 46, that is, is driven in the discharge direction by a fourth predetermined amount. Thereby, due to the moving away of the coins from the stacking surface guide 40, and the conveying force of the storage portion conveyor belt 36, the interval between coins widens on the storage portion conveyor belt 36 so that the overlapping amount of adjacent coins becomes less, whereby the slope angle with respect to the storage portion conveyor belt 36 becomes small. In this state, the coins are conveyed and a portion of them are discharged to the carton 27. Next, the control portion rotates the storage portion conveyor belt 36 in the normal direction, that is the reverse direction of the discharge direction by a fifth predetermined amount (fourth predetermined amount>fifth predetermined amount) and then rotates the storage portion conveyor belt 36 in the forward direction with respect to the discharge direction by a sixth predetermined amount (sixth predetermined amount>fifth predetermined amount) to discharge a portion of the coins. The control portion then once again rotates the storage portion conveyor belt 36 in the reverse direction of the discharge direction by the fifth predetermined amount, and then rotates the storage portion conveyor belt 36 in the forward direction with respect to the discharge direction by the sixth predetermined amount to discharge a portion of the coins. By suitably repeating this operation, a moderate amount of the coins are intermittently discharged. At this time, in accordance with the storage amount of coins and the conveyance torque, the control may be performed so that for example as the storage amount increases, the fifth predetermined amount and the sixth predetermined amount are reduced and the number of repetitions increase.

When sufficient time has elapsed for returning all of the coins of the temporary storage portions 33A to 33F to the carton 27, the control portion stops the drive motor 46 and returns the return gate opening-closing mechanism 74 to the standby state.

According to the coin processor of the present embodiment described above, the one side conveyor guide 38 that is disposed on one edge side in the width direction of the storage portion conveyor belt 36 and the other side conveyor guide 39 that is disposed on the other edge side in the width direction of the storage portion conveyor belt 36 are disposed with a spacing narrower than the diameter of the coin to be stored. For this reason, when a coin that is identified by the identifying portion 24 is introduced to the temporary storage portions 33A to 33F, the coin, due to the slope of the other side conveyor guide 39 that faces upward toward the outside in the width direction of the temporary storage portions 33A to 33F, becomes an oblique orientation conforming to this slope. Moreover, the coin makes contact with the storage portion conveyor belt 36, the one side conveyor guide 38, and the other side conveyor guide 39 in approximately the middle portion of the storage portion conveyor belt 36 in the lengthwise direction.

At this time, the storage portion conveyor belt 36 is driven in the direction in which the conveyor surface 36*a* heads toward the one end portion in the lengthwise direction. For this reason, the coin is in contact with the storage portion conveyor belt 36, the one side conveyor guide 38, and the other side conveyor guide 39, and due to frictional resistance of the one side conveyor guide 38 and the other side conveyor guide 39, a force that causes it to move toward the one end portion in the lengthwise direction of the storage portion conveyor belt 36 is applied by the storage portion conveyor belt 36 to the lower end portion of the coin in contact with the storage portion conveyor belt 36.

As a result, the coin moves toward the one end portion in the lengthwise direction of the storage portion conveyor belt 36 while rotating as a whole. The coin mounts the stacking surface guide 40 that is provided at this one end portion, blocks this one end side, and slopes upward toward the outside in the lengthwise direction of the storage portion conveyor belt 36, and stops in the orientation conforming to the stack slope surface 40*a* of the stacking surface guide 40.

The following coins mount the coin that has stopped in the orientation of rising forward with respect to the conveying direction and stop in the orientation conforming to this coin. In this way, in the respective temporary storage portions 33A to 33F the coins that are introduced one after another are guided to the stacking surface guide 40 and stacked along the lengthwise direction of the storage portion conveyor belt 36 with the same sloping orientation. Thereby, it is possible to stack a plurality of coins that are introduced one after another in the respective temporary storage portions 33A to 33F in alignment along the lengthwise direction of the storage portion conveyor belt 36 while partially staggering with an approximately constant oblique orientation. Accordingly, it is possible to suppress the repetition rotation phenomenon and bridging of coins that occurs during conveying. For this reason, by preventing coins from being held up, it is possible to properly convey coins.

Since it is possible to convey coins while rotating them in a definite direction as described above, it is possible to smoothly carry out conveying and stacking of coins even if there are scratches or the like on coins or an adhesive substance on the coins.

In the respective temporary storage portions 33A to 33F, the upper portion side of the one side conveyor guide 38 slopes so as to be positioned on the other edge side, that is, the side of the other side conveyor guide 39. For this reason, it is possible to reliably put coins in an oblique orientation along the slope of the other side conveyor guide 39. Also, it is possible to prevent the coins from colliding with other coins and flying out or shifting in the lateral direction during conveying or while stacked. Accordingly, by preventing the coins from being held up, it is possible to ensure the proper conveying of coins.

The introduction portion 50 that introduces coins to be stored onto the storage portion conveyor belt 36 is formed in the other side conveyor guide 39. For this reason, the coins satisfactorily become an oblique orientation along the slope of the other side conveyor guide 39, and make contact with the three points of the storage portion conveyor belt 36, the one side conveyor guide 38, and the other side conveyor guide 39. Therefore, it is possible to more smoothly carry out the above-described conveying and stacking of coins. Also, since the introduction portion 50 is formed in the vicinity of the other end portion in the lengthwise direction of the storage portion conveyor belt 36, it is possible to increase the capacity of coins to be stored.

The drive motor 46 is constituted to be capable of forward and reverse driving of the storage portion conveyor belt 36. For this reason, by driving the storage portion conveyor belt 36 in the direction in which the conveyor surface 36*a* that is the upper surface thereof heads toward the one end portion in the lengthwise direction, the stacking described above becomes possible. On the other hand, by driving the storage portion conveyor belt 36 in the reverse direction, it is possible to release the stacking of coins and discharge the coins from the other end portion side in the lengthwise direction to the carton 27.

When discharging coins of the temporary storage portions 33A to 33F from the one end portion side in the lengthwise direction of the storage portion conveyor belt 36 to the housing portions 67A to 67F, in the case of there being many coins to be stored, after the drive motor 46 once rotates the storage portion conveyor belt 36 in the reverse direction of the discharge direction, or while repeating rotation in the reverse direction of the discharge direction and rotation in the discharge direction, performs discharge of coins from the one end portion side in the lengthwise direction of the storage portion conveyor belt 36. By this operation, it is possible to discharge coins after satisfactorily releasing the stacking state of the coins. Therefore, during the discharge, the coins are prevented from flying out in an improper direction and from becoming congested. That is, in the case of the stacking pressure being strong due to there being many subsequent coins, the coins at the distal end side of the discharge fly out in an improper direction due to that force and coin congestion due to interference of among coins occurs, but it is possible to prevent this.

When discharging coins of the temporary storage portions 33A to 33F from the other end portion side in the lengthwise direction of the storage portion conveyor belt 36 to the carton 27, in the case of the number of coins to be stored being many, the drive motor 46, while repeating rotation of the storage portion conveyor belt 36 in the discharge direction and rotation in the reverse direction of the discharge direction, performs discharge of coins from the other end portion side in the lengthwise direction of the storage portion conveyor belt 36. By this operation, it is possible to perform discharge after satisfactorily releasing the stacking state of the coins. Therefore, during the discharge, the coins are prevented from flying out in an improper direction and from becoming congested. That is, when many coins are discharged in bulk, jumping and flying out of coins and coin congestion due to interference among coins in the carton 27 occurs, but it is possible to prevent these.

When the stacking surface guide 40 is in the stacking position that slopes upward toward the outside in the lengthwise direction of the storage portion conveyor belt 36, stacking of the coins as described above is performed, and by putting the stacking surface guide 40 in the retracted position that opens the one end portion of the temporary storage portions 33A to 33F in the lengthwise direction of the storage portion conveyor belt 36, it is possible to discharge coins from this one end portion.

The housing gate locking mechanism 61 is provided that is capable of locking the stacking surface guide 40 in the stack position. For this reason, it is possible to prevent coins being improperly discharged from the one end portion in the lengthwise direction of the storage portion conveyor belt 36 as a result of movement or the like of the stacking surface guide 40 due to stacking pressure on the side of the housing portions 67A to 67F stemming from the weight of the coins that have been stacked.

By putting the other end portion of the temporary storage portions 33A to 33F in the lengthwise direction of the storage portion conveyor belt 36 in the closed state with the return opening-closing gate 70, it is possible to prevent the coins from being improperly discharged from this other end portion. Meanwhile, by putting this return opening-closing gate 70 in the opened state, it is possible to discharge coins from the other end portion of the temporary storage portions 33A to 33F in the lengthwise direction of the storage portion conveyor belt 36.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A coin processor comprising a temporary storage portion that temporarily stores coins, the temporary storage portion comprising:

a conveyor belt that is disposed approximately horizontally, and conveys a coin by making point contact with the coin;

a one side conveyor guide that is disposed on one edge side of the conveyor belt in a width direction thereof;

an other side conveyor guide that is disposed on an other edge side of the conveyor belt in the width direction with a spacing narrower than a diameter of a coin to be stored between the one side conveyor guide and the other side conveyor guide, and that slopes upward toward outside in the width direction, the conveyor belt being disposed between a lower end edge of the one side conveyor guide and a lower end edge of the other side conveyor guide;

a drive portion that drives the conveyor belt; and a stacking surface guide that is provided at one end portion of the conveyor belt in a lengthwise direction thereof, and that slopes upward toward outside of the conveyor belt in the lengthwise direction.

2. The coin processor according to claim 1, wherein an upper portion side of the one side conveyor guide slopes so as to be positioned at the other edge side.

3. The coin processor according to claim 1, wherein an introduction portion that introduces the coin to be stored to the conveyor belt is formed in a vicinity of the other end portion of the other side conveyor guide in the lengthwise direction of the conveyor belt.

4. The coin processor according to claim 1, wherein the drive portion normally and reversely rotates the conveyor belt.

5. The coin processor according to claim 4, wherein the drive portion, when discharging coins from one of the one end portion side and the other end portion side of the conveyor belt in the lengthwise direction, discharges the coins from one of the one end portion side and the other end portion side of the conveyor belt in the lengthwise direction after rotating the conveyor belt once in a reverse direction of a discharge direction or while repeating rotation of the conveyor belt in the discharge direction and the reverse direction.

6. The coin processor according to claim 1, wherein the stacking surface guide moves to a stacking position in which the stacking surface guide slopes upward toward the outside of the conveyor belt in the lengthwise direction and to a retracted position in which the stacking surface guide opens one end portion of the temporary storage portion in the lengthwise direction of the conveyor belt.

7. The coin processor according to claim 6, further comprising a locking mechanism that locks the stacking surface guide in the stacking position.

8. The coin processor according to claim 1, further comprising an opening-closing gate that opens and closes an other end portion of the temporary storage portion in the lengthwise direction of the conveyor belt.

9. The coin processor according to claim 1, further comprising:

a money receiving portion in which coins are charged;

an identifying portion that identifies the coins that are charged into the money receiving portion;

a returning portion that returns the coins that are temporarily stored in the temporary storage portion; and a housing portion that houses the coins that are temporarily stored in the temporary storage portion, wherein the temporary storage portion temporarily stores the coins that are identified by the identifying portion.

10. The coin processor according to claim 1, wherein the conveyor belt is arranged so as to make point contact with one end portion of a sloping lower side of a lower surface of the coin, the one side conveyor guide is arranged so as to make point contact with one end portion of a sloping lower side of an upper surface of the coin, and the other side conveyor guide is arranged so as to make point contact with a slopping upper side of the lower surface of the coin.

* * * * *